US006906597B2

(12) United States Patent
Nozu et al.

(10) Patent No.: US 6,906,597 B2
(45) Date of Patent: Jun. 14, 2005

(54) NON-RECIPROCAL CIRCUIT DEVICE AND RESIN CASING USED THEREFOR

(75) Inventors: Minoru Nozu, Tottori-ken (JP); Kenji Kuramoto, Tottori-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 30 days.

(21) Appl. No.: 10/282,055

(22) Filed: Oct. 29, 2002

(65) Prior Publication Data

US 2003/0080820 A1 May 1, 2003

(30) Foreign Application Priority Data

Oct. 29, 2001 (JP) ..... 2001-331422

(51) Int. Cl.[7] ..... H01P 1/32
(52) U.S. Cl. ..... 333/1.1; 333/24.2
(58) Field of Search ..... 333/1.1, 24.2

(56) References Cited

U.S. PATENT DOCUMENTS 6,215,371 B1 * 4/2001 Kurahashi et al. ..... 333/1.1
6,545,558 B2 * 4/2003 Hasegawa ..... 333/1.1
6,549,086 B2 * 4/2003 Kawanami ..... 333/1.1
6,597,253 B2 * 7/2003 Umegaki ..... 333/1.1

FOREIGN PATENT DOCUMENTS

JP 1-198802 8/1989
JP 10-135711 5/1998
JP 10-303607 11/1999
JP 2001267811 A * 9/2001

* cited by examiner

*Primary Examiner*—Stephen E. Jones
(74) *Attorney, Agent, or Firm*—Finnegan, Henderson, Farabow, Garrett, and Dunner, LLP

(57) ABSTRACT

A resin casing for use in a non-reciprocal circuit device comprising an assembly of a ferrimagnetic body and a plurality of central conductors enclosing it, and a plurality of elongated flat capacitors connected to ends of the central conductors; the resin casing being constituted by a thin conductor plate having a substantially flat bottom portion and a resin frame injection-molded integrally with the thin conductor plate; the resin frame comprising sidewalls, and partition walls provided inside the sidewalls for defining a plurality of recesses for receiving the flat capacitors, a pair of opposing sidewalls being provided with external terminals constituted by the thin conductor plate; any bottoms of a plurality of the recesses being integrally constituted by a substantially flat bottom portion of the thin conductor plate; the recesses being formed such that all flat capacitors received in the recesses are aligned substantially in parallel with sidewalls having external terminals; and the assembly being disposed on the flat capacitors received in the recesses.

10 Claims, 18 Drawing Sheets

A-A' Cross Section

B-B' Cross Section

C-C' Cross Section

D-D' Cross Section

E-E' Cross Section

G-G' Cross Section

H-H' Cross Section

I-I' Cross Section

J-J' Cross Section

K-K' Cross Section

NON-RECIPROCAL CIRCUIT DEVICE AND RESIN CASING USED THEREFOR

FIELD OF THE INVENTION

The present invention relates to a non-reciprocal circuit device having non-reciprocal transmission characteristics to high-frequency signals and a resin casing used therein, particularly to a non-reciprocal circuit device used in mobile communications systems such as cellular phones, etc., which are generally called an isolator or a circulator, and a resin casing therefor.

BACKGROUND OF THE INVENTION

There is a non-reciprocal circuit device such as an isolator, a circulator, etc. as one of transmitting and receiving circuit parts for cellular phones, automobile phones, etc. used in a microwave band and a UHF band. Generally, the isolator and the circulator have small insertion loss in a signal transmission direction and large loss in an opposite direction, so that they are used to prevent the breakage of amplifiers.

FIG. 19 shows one example of the conventional isolators. This isolator is constituted by upper and lower metal casings 1, 12 functioning as magnetic yokes, a permanent magnet 2, an assembly 20, flat capacitors 8, 9, 10, a dummy resistor 11, and a resin casing 7.

The assembly 20 is constituted by a thin conductor plate having such a shape that three central conductors 4, 5, 6 are radially projecting from a circular shield plate, and a garnet-type ferrite (ferrimagnetic body) 3 disposed on a circular portion of the thin conductor plate, with the three central conductors 4, 5, 6 folded onto the garnet-type ferrite 3 and integrally overlapping via insulating layers therebetween.

The resin casing 7 has a circular recess 13*a* for the assembly 20 at center, and recesses 13*b*, 13*c*, 13*d* for flat capacitors around the circular recess 13*a*. The bottom of each recess 13*a*, 13*b*, 13*c*, 13*d* is provided with a connecting electrode 14*a*. The connecting electrode 14*a* is integrally formed by a thin conductor plate 14 of about 0.1 mm in thickness, and exposed from the sidewalls of the resin casing 7 as external terminals 15*a*–15*f*. The external terminals 15*a*–15*c* and the external terminals 15*d*–15*f* are exposed symmetrically on opposing side surfaces. The resin casing 7 is provided with terminal electrodes 16*a*, 16*b* connected to the central conductors 4, 5, and the terminal electrodes 16*a*, 16*b* are connected to the external terminals 15*a*, 15*d* on the side surfaces. The external terminal 15*a* and the terminal electrode 16*a* are formed by one integral thin conductor plate separate from the connecting electrode 14*a*, and the external terminal 15*d* and the terminal electrode 16*b* are formed by the other integral thin conductor plate separate from the connecting electrode 14*a*.

Each flat capacitor 8, 9, 10 is received in each recess 13*b*, 13*c*, 13*d* of the resin casing 7. Each flat capacitor 8, 9, 10 is constituted by electrodes formed on upper and lower surfaces of a flat dielectric substrate, and the lower electrode of each flat capacitor is connected by soldering to the connecting electrode 14*a* appearing in each bottom of the recesses 13*b*, 13*c*, 13*d*. Received in the recess 13*d* are the flat capacitor 10 and a dummy resistor 11, whose one electrode is connected by soldering to the connecting electrode 14*a*, and whose other electrode is connected to the central conductor 6.

The assembly 20 is disposed in the recess 13*a* of the resin casing 7. The circular shield plate of the central conductors

4, 5, 6 is connected to the connecting electrode 14*a* by soldering. With this structure the central conductors are grounded. One end of the central conductor 4 is connected to the upper electrode of the flat capacitor 8 and a terminal electrode 16*a*, and one end of the central conductor 5 is connected to the upper electrode of the flat capacitor 9 and a terminal electrode 16*b*.

The resin casing 7 is disposed on the lower casing 12. The lower casing 12 has a shape complemental to that of a recess 21 in the bottom of the resin casing 7. The connecting electrode 14*a* exposed from the recess 21 is connected to the lower casing 12 by soldering, so that the resin casing 7 is made integral with the lower casing 12. The permanent magnet 2 for applying a DC magnetic field to the garnet-type ferrite 3 is fixed to an inner wall of the upper casing 1. With the upper casing 1 mounted to the lower casing 12, a surface-mountable isolator is obtained. Incidentally, ends of the central conductors can be connected to the capacitors and the terminal electrodes, for instance, by soldering or spot welding (for instance, see JP 10-135711 A). Also, a circulator can be obtained when the same terminal electrode as that for the other central conductor is used in place of the dummy resistor 11.

With demand for miniaturization, higher performance and lower prices increasingly mounting not only for isolators but also for mobile communications equipment, present objectives are miniaturization by the level of several hundreds microns, increase in performance by the level of one-tenth of dB, and further reduction of cost. Though widely used at present are 5-mm-square isolators, there is demand for further miniaturization. Thus, the inventors have been developing isolators with a target of providing 4-mm-square isolators (nearly 40% reduction of mounting area).

When an isolator comprising flat capacitors is further miniaturized, the flat capacitors 8, 9, 10 and/or the garnet-type ferrite 3 should be reduced in size. However, because the capacitance C of the flat capacitor is represented by $C=\epsilon_r \cdot \epsilon_0 \cdot S/d$, wherein $\epsilon_r$ is a dielectric constant of a dielectric body, $\epsilon_0$ is a dielectric constant of vacuum, S is the area of an electrode, and d is the thickness of a dielectric body, the reduction of the flat capacitor in a planar size makes it necessary to use a dielectric body having a large dielectric constant $\epsilon_r$ or make the dielectric body thinner, to obtain the same capacitance. However, a dielectric body having a large dielectric constant $\epsilon_r$ generally tends to have a large dielectric loss. Thus, the larger the dielectric loss, the larger the insertion loss of the resultant isolator. In addition, the reduction of a dielectric body in thickness results in decrease in the mechanical strength of a flat capacitor, making it likely that breakage, cracking, etc. occur at the time of assembling a non-reciprocal circuit device.

The miniaturization of a garnet-type ferrite is accompanied by the problem that a frequency band, in which the desired insertion loss is obtained, is narrowed. Further, the reduction of a garnet-type ferrite in diameter results in decrease in inductance obtained by the central conductors and the garnet-type ferrite. Therefore, the capacitance of flat capacitors should be increased to obtain a necessary operation frequency, resulting in increase in the size of the flat capacitors. In the conventional non-reciprocal circuit device, the reduction of a garnet-type ferrite is at most 2.2 mm in diameter, and the use of a smaller garnet-type ferrite than this size results not only in the deterioration of electric characteristics but also in the necessity of using larger flat capacitors. Accordingly, in the conventional structure in which flat capacitors are arranged around an assembly, it has been difficult to provide a small non-reciprocal circuit device with practically acceptable characteristics.

In the conventional isolator, flat capacitors 8, 9, 10 are arranged around the assembly 20 in a U-shaped pattern. The flat capacitor 10 connected in parallel to the dummy resistor 11 is disposed perpendicularly to a row of external terminals 15*a*–15*f* mounted onto the resin casing 7. Accordingly, when a bending force is applied to the non-reciprocal circuit device by the flexure of the circuit board, onto which the non-reciprocal circuit device is mounted, etc., the resin casing 7 is deformed with the external terminals 15*a*–15*f* as a fulcrum. As a result, the flat capacitor 10 connected in parallel to the dummy resistor is broken.

As another example, JP 10-303607 A discloses an isolator having a structure, in which erect capacitors are arranged in a resin casing such that the electrode surfaces of capacitors are substantially parallel to the center axis of a garnet-type ferrite, a garnet-type ferrite being disposed in a space encircled by the capacitors. However, such an isolator comprises a resin casing with a complicated structure, and it is thus difficult to handle the capacitors during assembling.

OBJECT OF THE INVENTION

Accordingly, an object of the present invention is to provide a resin casing that can serve to miniaturize a non-reciprocal circuit device and prevent the breakage of flat capacitors by a force applied from outside to the non-reciprocal circuit device, and a small and highly reliable non-reciprocal circuit device comprising such a resin casing.

DISCLOSURE OF THE INVENTION

The first resin casing of the present invention used in a non-reciprocal circuit device comprising an assembly of a ferrimagnetic body and a plurality of central conductors enclosing the ferrimagnetic body, and a plurality of elongated flat capacitors connected to ends of the central conductors comprises a thin conductor plate having a substantially flat bottom portion, and a resin frame injection-molded integrally with the thin conductor plate; the resin frame having sidewalls and partition walls inside the sidewalls for defining a plurality of recesses for receiving the flat capacitors; a pair of opposing sidewalls being provided with external terminals constituted by the thin conductor plate; any bottoms of a plurality of the recesses being integrally formed by a substantially flat bottom portion of the thin conductor plate; the recesses being formed such that they receive all of the flat capacitors substantially in parallel with sidewalls having the external terminals; and the assembly being disposed on the flat capacitors received in the recesses.

The second resin casing of the present invention used in a non-reciprocal circuit device comprising an assembly of a ferrimagnetic body and a plurality of central conductors enclosing the ferrimagnetic body, and a plurality of elongated flat capacitors connected to ends of the central conductors comprises a conductor plate constituting a magnetic yoke for the non-reciprocal circuit device and having a substantially flat bottom surface, and a resin frame injection-molded integrally with the conductor plate; the resin frame having sidewalls and partition walls inside the sidewalls for defining a plurality of recesses for receiving the flat capacitors; a pair of opposing sidewalls being provided with external terminals constituted by the conductor plate; any bottoms of a plurality of the recesses being integrally formed by a substantially flat bottom portion of the conductor plate; the recesses being formed such that they receive all of the flat capacitors substantially in parallel with sidewalls having the external terminals; and the assembly being disposed on the flat capacitors received in the recesses.

In a preferred embodiment of the present invention, the resin casing comprises three recesses for receiving three elongated flat capacitors. The electrode surfaces of the flat capacitors connected to ends of the central conductors preferably have substantially the same height.

It is preferable that the partition walls are not higher than the electrode surfaces of the flat capacitors connected to ends of the central conductors, and that the sidewalls are higher than the electrode surfaces of the flat capacitors. This prevents the partition walls from interfering with the assembly disposed on the flat capacitors. In addition, because the resin casing has sidewalls higher than the electrode surfaces of the flat capacitors connected to ends of the central conductors, the rigidity of the resin casing can be kept.

It is preferable that the resin frame has second partition walls along the short side surfaces of the recesses adjacent to the sidewalls having the external terminals, and that the second partition walls are higher than the partition walls between the recesses and equal to or lower than the sidewalls.

The first non-reciprocal circuit device of the present invention comprises a resin casing, to which an assembly of a ferrimagnetic body and a plurality of central conductors enclosing the ferrimagnetic body, a permanent magnet for applying a DC magnetic field to the ferrimagnetic body, and a plurality of elongated flat capacitors connected to ends of the central conductors are assembled; the resin casing comprising a thin conductor plate having a substantially flat bottom portion, and a resin frame injection-molded integrally with the thin conductor plate; the resin frame having sidewalls and partition walls inside the sidewalls for defining a plurality of recesses for receiving the flat capacitors; a pair of opposing sidewalls being provided with external terminals constituted by the thin conductor plate; any bottoms of a plurality of the recesses being integrally formed by a substantially flat bottom portion of the thin conductor plate; the recesses being formed such that they receive all of the flat capacitors substantially in parallel with sidewalls having the external terminals; and the assembly being disposed on the flat capacitors received in the recesses.

The second non-reciprocal circuit device of the present invention comprises a resin casing, to which an assembly of a ferrimagnetic body and a plurality of central conductors enclosing the ferrimagnetic body, a permanent magnet for applying a DC magnetic field to the ferrimagnetic body, and a plurality of elongated flat capacitors connected to ends of the central conductors are assembled; the resin casing comprising a conductor plate constituting a magnetic yoke for the non-reciprocal circuit device and having a substantially flat bottom surface, and a resin frame injection-molded integrally with the conductor plate; the resin frame having side walls and partition walls inside the sidewalls for defining a plurality of recesses for receiving the flat capacitors; a pair of opposing sidewalls being provided with external terminals constituted by the thin conductor plate; any bottoms of a plurality of the recesses being integrally formed by a substantially flat bottom portion of the thin conductor plate; the recesses being formed such that they receive all of the flat capacitors substantially in parallel with sidewalls having the external terminals; and the assembly being disposed on the flat capacitors received in the recesses.

In both non-reciprocal circuit devices, the other ends of the central conductors are preferably at substantially the same potential but not grounded.

When the non-reciprocal circuit device comprises a resistor connected in parallel to one of the flat capacitors, it is operated as an isolator. This resistor is preferably a chip resistor from the aspect of withstand-voltage. This resistor is preferably disposed in a recess enclosed by the sidewalls and a second partition wall formed along a short side surface of a recess adjacent to a sidewall having the external terminals.

In a preferred embodiment of the present invention, the non-reciprocal circuit device comprises three flat capacitors, one flat capacitor connected in parallel to the resistor being disposed between other two flat capacitors.

BRIEF DESCRIPTION OF THE DRAWINGS

FIG. 1(*b*) is a side view showing a sidewall provided with external terminals, among the sidewalls of the resin casing of FIG. 1(*a*);

FIG. 1(*c*) is a bottom view showing the resin casing of FIG. 1(*a*);

FIG. 2(*b*) is a cross-sectional view taken along the line B–B' in FIG. 1(*a*);

FIG. 2(*c*) is a cross-sectional view taken along the line C–C' in FIG. 1(*a*);

FIG. 3(*b*) is a cross-sectional view taken along the line E–E' in FIG. 1(*a*);

FIG. 5(*b*) is a plan view showing the leadframe of FIG. 5(*a*), whose portions corresponding to electrodes are bent;

FIG. 6(*b*) is a plan view showing the injection-molded product of FIG. 6(*a*), whose external terminals are bent;

FIG. 9(*b*) is a cross-sectional view taken along the line F–F' in FIG. 9(*a*);

FIG. 11(*b*) is a graph showing the relation between isolation and frequency, and between return loss and frequency in the non-reciprocal circuit device of the first embodiment;

FIG. 12(*b*) is a side view showing a sidewall provided with external terminals, among the sidewalls of the resin casing of FIG. 12(*a*);

FIG. 12(*c*) is a bottom view showing the resin casing of FIG. 12(*a*);

FIG. 13(*b*) is a cross-sectional view taken along the line H–H' in FIG. 12(*a*);

FIG. 13(*c*) is a cross-sectional view taken along the line I–I' in FIG. 12(*a*);

FIG. 14(*b*) is a cross-sectional view taken along the line K–K' in FIG. 12(*a*);

FIG. 15(*b*) is a plan view showing the leadframe of FIG. 15(*a*), to which bending operation has been carried out;

DESCRIPTION OF THE PREFERRED EMBODIMENTS

The non-reciprocal circuit device of the present invention will be explained in detail referring to the attached drawings, taking an isolator for example, though the present invention is of course not restricted to the isolator.

[1] First Embodiment

A resin casing for a non-reciprocal circuit device according to the first embodiment of the present invention and a non-reciprocal circuit device comprising it will be explained in detail below referring to FIGS. 1–9.

Figure 1A:
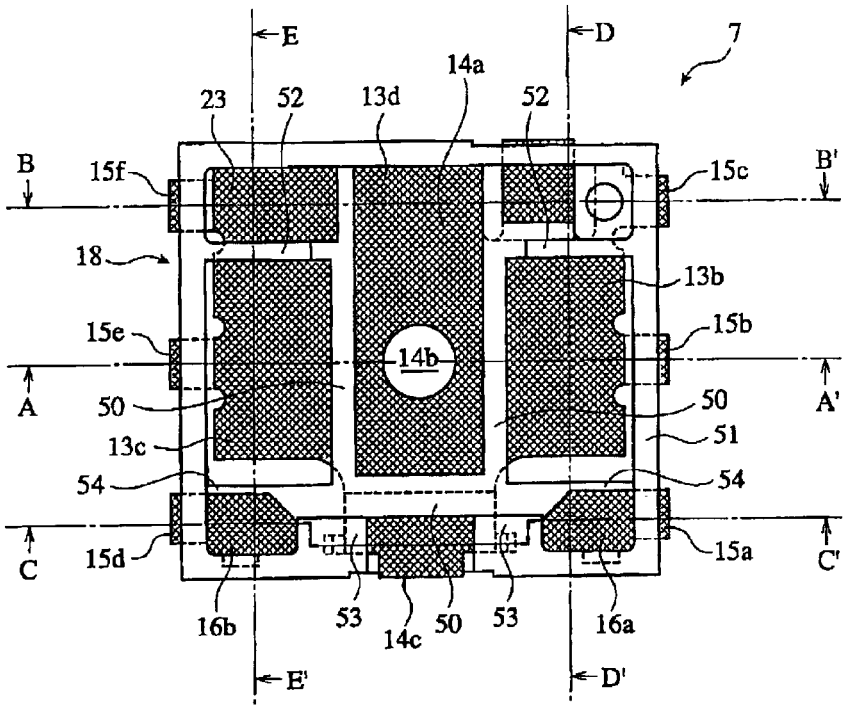
FIG. 1(*a*) is a plan view showing a resin casing for a non-reciprocal circuit according to one embodiment of the present invention.
Figure 1B:
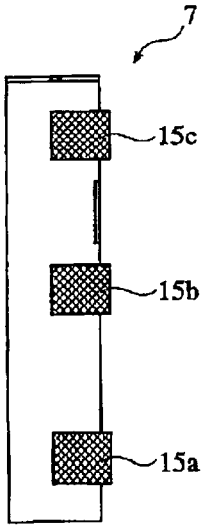
Figure 1C:
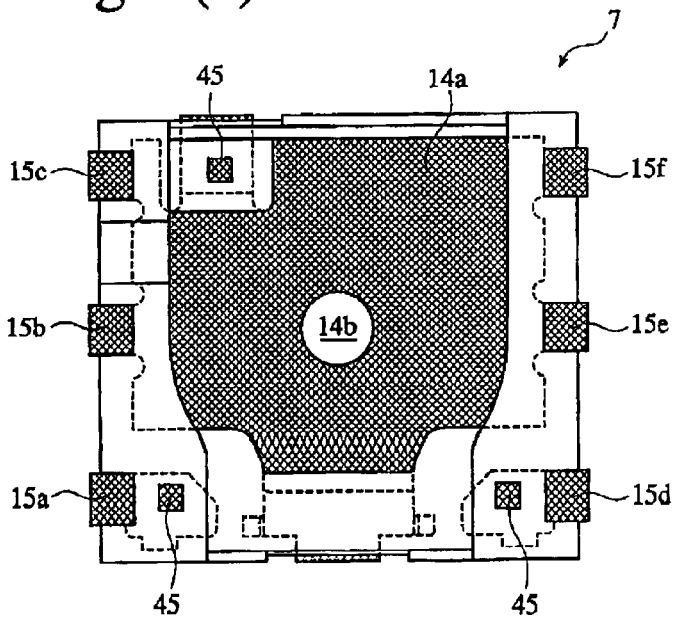
Figure 2A:
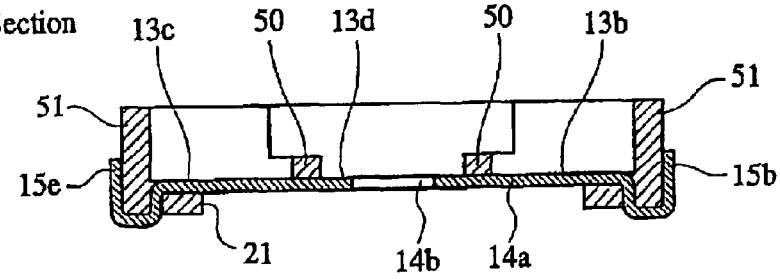
FIG. 2(*a*) is a cross-sectional view taken along the line A–A' in FIG. 1(*a*)
Figure 2B:
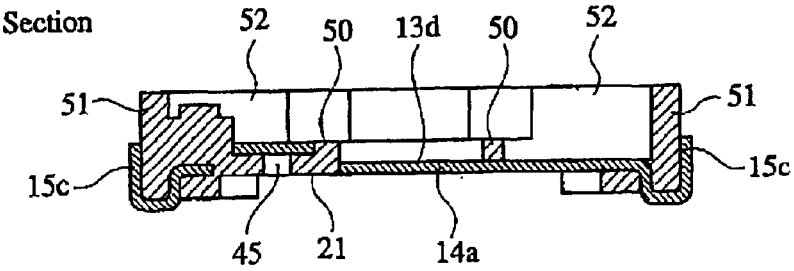
Figure 2C:
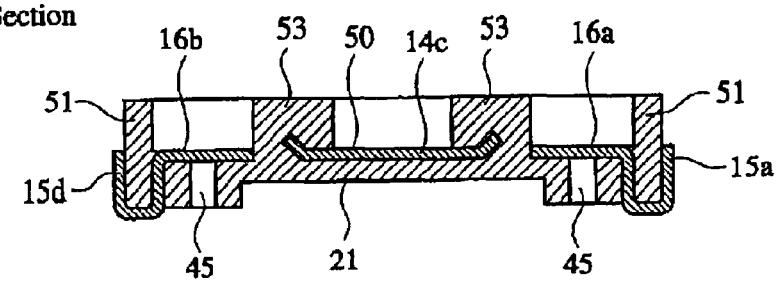
Figure 3A:
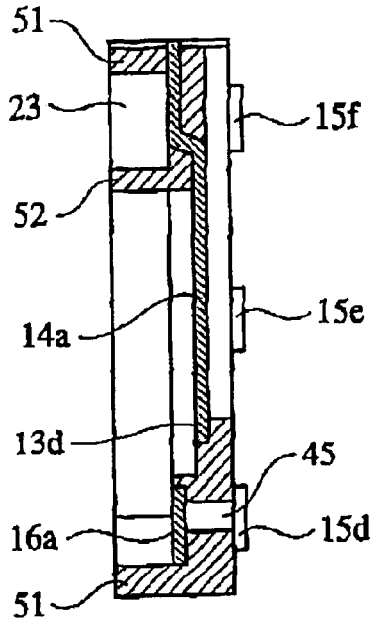
FIG. 3(*a*) is a cross-sectional view taken along the line D–D' in FIG. 1(*a*)
Figure 3B:
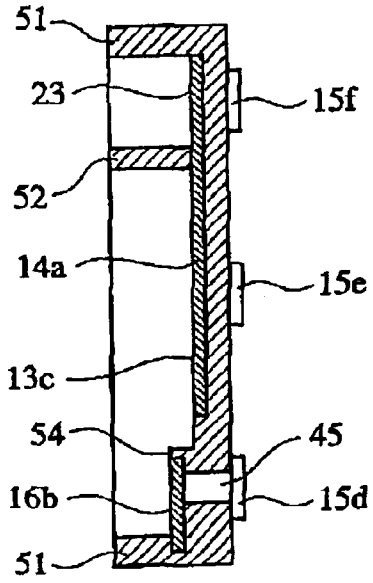
Figure 4:
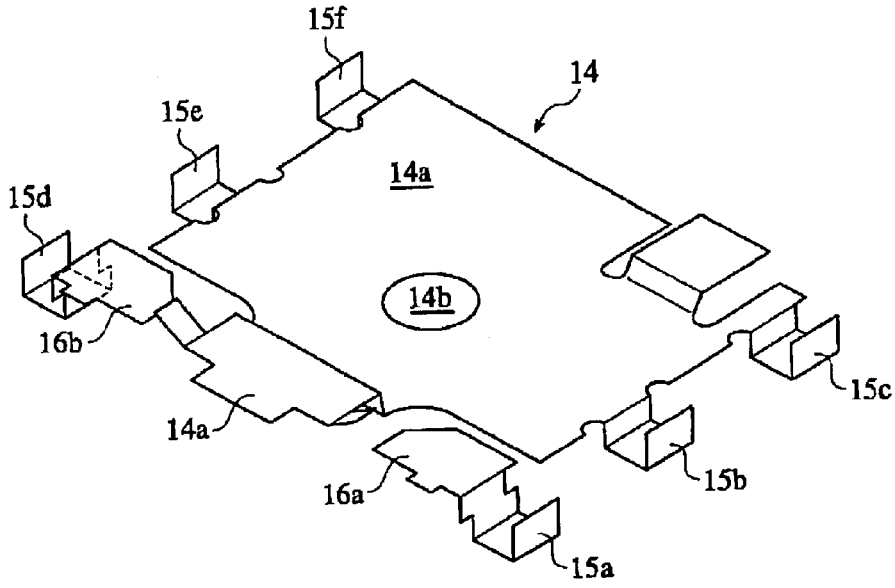
FIG. 4 is a perspective view showing a thin conductor plate used in the resin casing of FIG. 1(*a*)

The resin casing 7 comprises a thin conductor plate 14 comprising a connecting electrode 14*a* and external terminals 15*a*–15*f*, and a resin frame 18 molded integrally therewith. The overall structure of the thin conductor plate 14 is shown in FIG. 4. The resin casing 7 is provided with recesses 13*b*, 13*c*, 13*d* for receiving flat capacitors 8, 9, 10, and a recess 23 in which a dummy resistor 11 connected in parallel to the flat capacitor 10 is disposed. The resin casing 7 may be integrally formed by injection-molding high-heat-resistance thermoplastic engineering plastics such as liquid crystal polymers, polyphenylene sulfide, etc. in a die in which a thin conductor plate 14, for instance, an about 0.1-mm-thick copper plate, is placed.

A thin copper plate 14 may be coated with a high-conductivity metal layer made of at least one of silver, gold, copper and aluminum or its alloy, which has electric resistivity of 5.5 $\mu\Omega$ cm or less, preferably 3.0 $\mu\Omega$ cm or less, more preferably 1.8 $\mu\Omega$ cm or less, to increase the transmission efficiency of microwave signals, and to reduce loss by suppressing interference with the outside. The thickness of the high-conductivity metal layer is 0.5–25 $\mu$m, preferably 0.5–10 $\mu$m, more preferably 1–8 $\mu$m.

A flat thin conductor plate 14 is exposed as a common connecting electrode 14*a* from the bottoms of three recesses 13*b*, 13*c*, 13*d* for receiving flat capacitors 8, 9, 10. The flat capacitors 8, 9, 10 are disposed in the same plane in the recesses 13*b*, 13*c*, 13*d*, with the lower electrodes of the flat capacitors 8, 9, 10 connected by soldering to the connecting electrode 14*a* exposed from the bottoms of the recesses 13*b*, 13*c*, 13*d*. A dummy resistor 11 is disposed in a recess 23, and one electrode of the dummy resistor 11 is connected by soldering to the connecting electrode 14*a*.

The assembly 20 per se may be the same as a conventional one. For instance, the assembly 20 comprises a thin conductor plate having such a shape that three central conductors 4, 5, 6 are radially projecting from a circular shield plate, and a garnet-type ferrite 3 disposed on a circular portion of the thin conductor plate, with three central conductors 4, 5, 6 folded to integrally overlap the garnet-type ferrite 3. The assembly 20 is disposed on the flat capacitors 8, 9, 10 via an insulating member 22, for instance, an insulating sheet made of a polyimide resin, etc. One end of the central conductor 4 is connected to an upper electrode of the flat capacitor 8 and a terminal electrode 16*a*, one end of the central conductor 5 is connected to an upper electrode of the flat capacitor 9 and a terminal electrode 16*b*, and one end of the central conductor 6 is connected to an upper electrode of the flat capacitor 10 and a dummy resistor 11.

In the resin casing 7 of the present invention, the electrode surfaces of the flat capacitors 8, 9, 10 have substantially the same height, and partition walls 50 between the recesses 13*b*, 13*c*, 13*d* for receiving the flat capacitors 8, 9, 10 are not higher than the electrode surfaces of the flat capacitors 8, 9, 10. Accordingly, the assembly 20 can be disposed on the flat capacitors 8, 9, 10 stably without inclination. Also, because the three flat capacitors 8, 9, 10 are connected to the same electrode 14, the electrode surfaces of the flat capacitors 8, 9, 10 having an equal thickness have substantially the same height. Further, the flat capacitors 8, 9 disposed on both sides of the flat capacitor 10 may have substantially the same thickness, and the flat capacitor 10 may be thinner than the flat capacitors 8, 9, to achieve the stable arrangement of the assembly 20.

The sidewalls 51 of the resin casing 7 are higher than the electrode surfaces of the flat capacitors 8, 9, 10 connected to ends of the central conductors 4, 5, 6, and a pair of opposing sidewalls are provided with external terminals 15*a*–15*f* constituted by the thin copper plate. The external terminals 15*b*, 15*c*, 15*e*, 15*f* are connected to the connecting electrode 14*a*. The resin casing 7 comprises partition walls 52 opposing the shorter sidewalls (end surfaces) of the flat capacitors 8, 9, 10, in addition to the sidewalls 51 and the partition walls 50 between the flat capacitors 8, 9, 10. The partition walls 52 are higher than the partition walls 50 between the recesses 13*b*, 13*c*, 13*d* but equal to or lower than the sidewalls 51. The dummy resistor 11 connected in parallel to the flat capacitor 10 is received in a recess 23 defined by the sidewalls 51 and one partition wall 52. The sidewalls 51 integrally have portions 53 opposing the partition walls 52 via the flat capacitors 8, 9, which project toward the assembly 20, and the assembly 20 is positioned in the resin casing 7 by the inwardly projecting portions 53 and the partition walls 52.

In the resin casing 7, each flat capacitor 8, 9, 10 is disposed in each recess 13*b*, 13*c*, 13*d* with the longitudinal direction of each flat capacitor 8, 9, 10 being substantially the same as that of each recess 13*b*, 13*c*, 13*d*. Each recess 13*b*, 13*c*, 13*d* is formed such that the longer sidewalls of all flat capacitors 8, 9, 10 are substantially in parallel with opposing sidewalls 51 of the resin casing 7 provided with external terminals 15*a*–15*f* constituted by the thin conductor plate 14. The resin casing 7 has a recess on the bottom side, from which the connecting electrode 14*a* is exposed. The lower casing 12 of the non-reciprocal circuit device is fitted in the recess 21 and integrally soldered to the connecting electrode 14*a*.

When a force is applied from outside to the resin casing 7 having a such shape in a thickness direction, flexure may occur with the external terminals 15*a*–15*f* as a fulcrum. Even so, the influence of flexure is extremely small on the flat capacitor 10 connected in parallel to the dummy resistor 11, whereby the flat capacitor 10 is not likely to be destroyed.

Figure 5A:
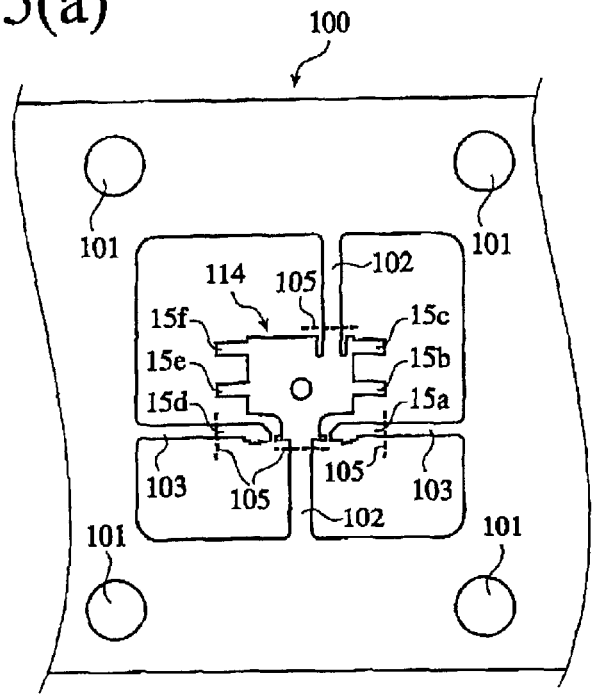
FIG. 5(*a*) in a partial plan view showing a leadframe for forming the thin conductor plate of FIG. 4.
Figure 5B:
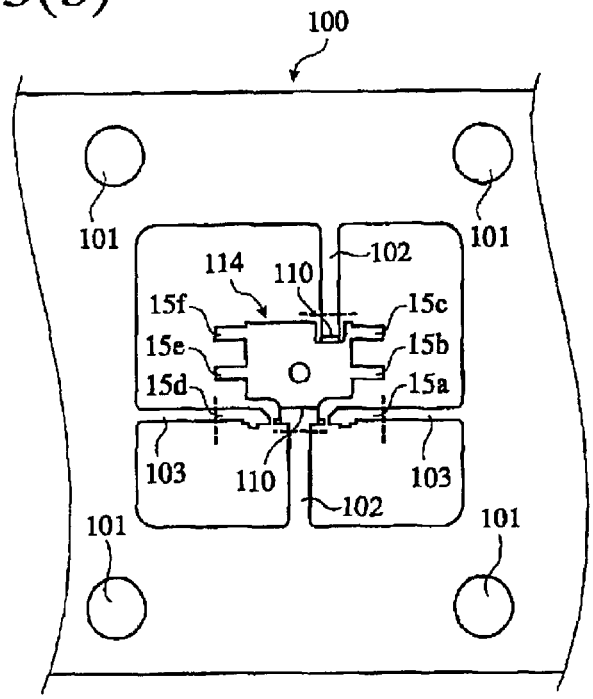
Figure 6A:
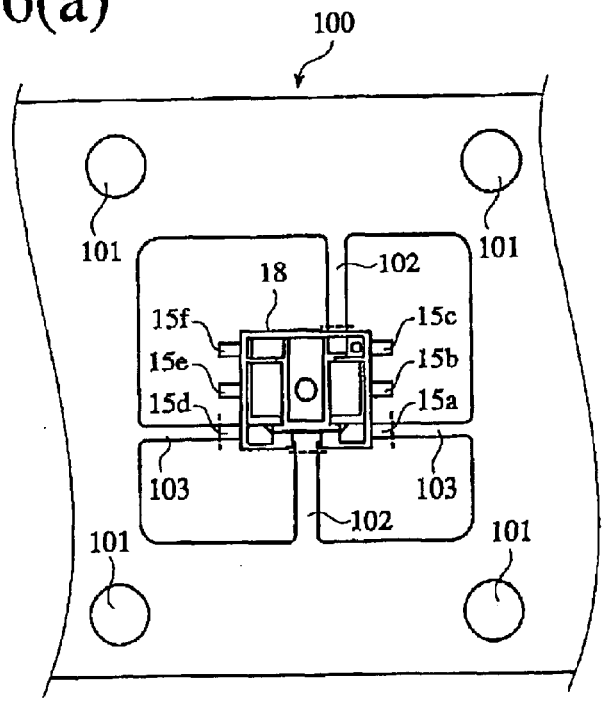
FIG. 6(*a*) is a plan view showing the leadframe of FIG. 5(*a*), with which a resin frame is injection-molded.
Figure 6B:
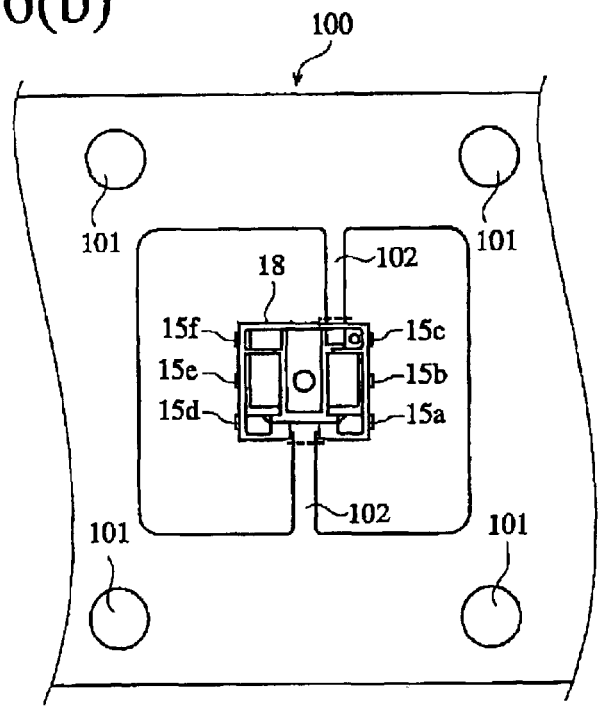

As shown in FIGS. 5 and 6, the thin conductor plate 14 may be formed from a leadframe 100 made of a conductive material such as copper, etc. The leadframe 100 has sprocket holes 101 in both edge portions (hoop portion) at a constant interval, and in each center portion encircled by four sprocket holes 101 a thin conductor plate portion 114 corresponding to the thin conductor plate 14 is integrally connected to a plurality of supports 102, 103 extending from the hoop portion. Each support 102, 103 is provided with a cutting line 105 having a V-shaped notch.

In the production of the thin conductor plate 14 from the leadframe 100 shown in FIG. 5(*a*), the leadframe 100 is first subjected to necessary bending along lines 110 as shown in FIG. 5(*b*). Next, as shown in FIG. 6(*a*), a thermoplastic resin frame 18 is formed integrally with the thin conductor plate portion 114 by an injection-molding method using a high-heat-resistance thermoplastic engineering plastic such as a liquid crystal polymer, polyphenylene sulfide, etc. In this case, injection molding may be carried out while the thin conductor plate portion 114 is still connected to the leadframe 100, or after it is cut from the leadframe 100. At the time of injection molding, a plurality of pins abut a rear surface of the thin conductor plate portion 114 to fix it. Accordingly, the resin casing 7 is provided with a plurality of holes 45 on a rear surface. After injection molding, as shown in FIG. 6(*b*), the external terminals 15*a*–15*f* are bent, and finally the support 102 is cut at the cutting line 105.

Figure 7:
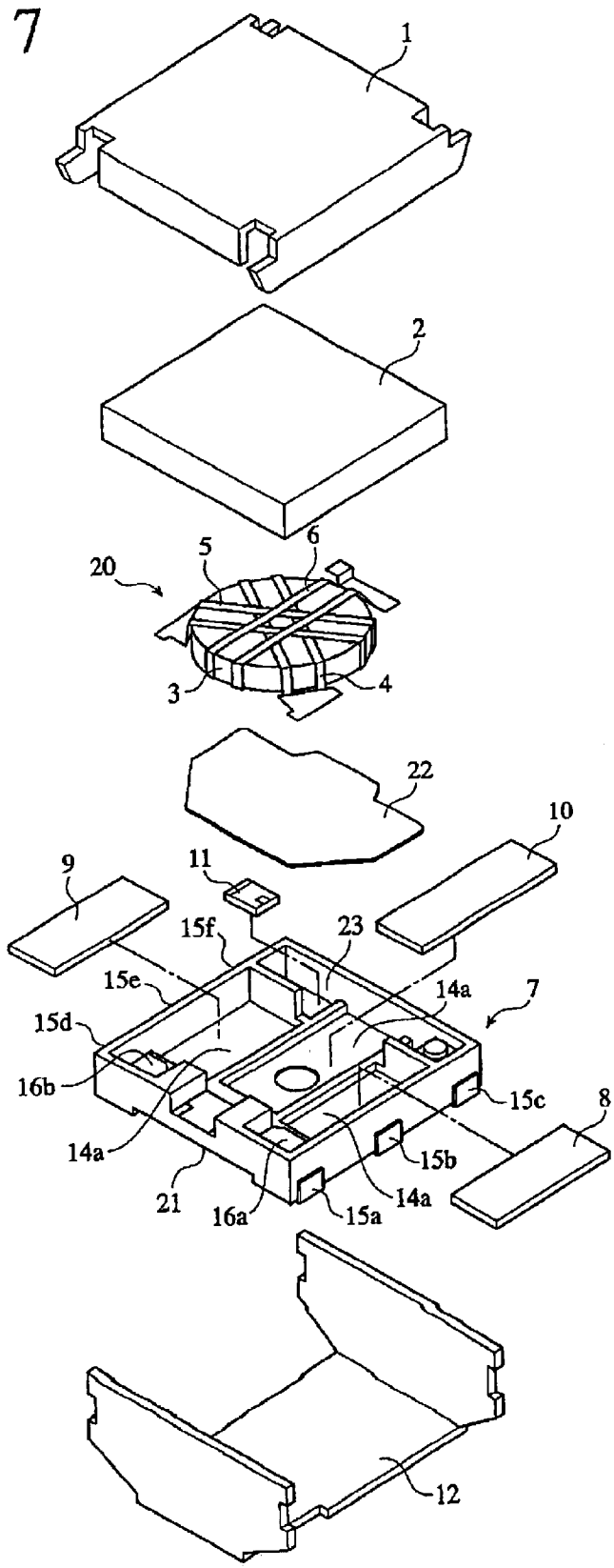
FIG. 7 is an exploded perspective view showing one example of the non-reciprocal circuit devices of the present invention.
Figure 8:
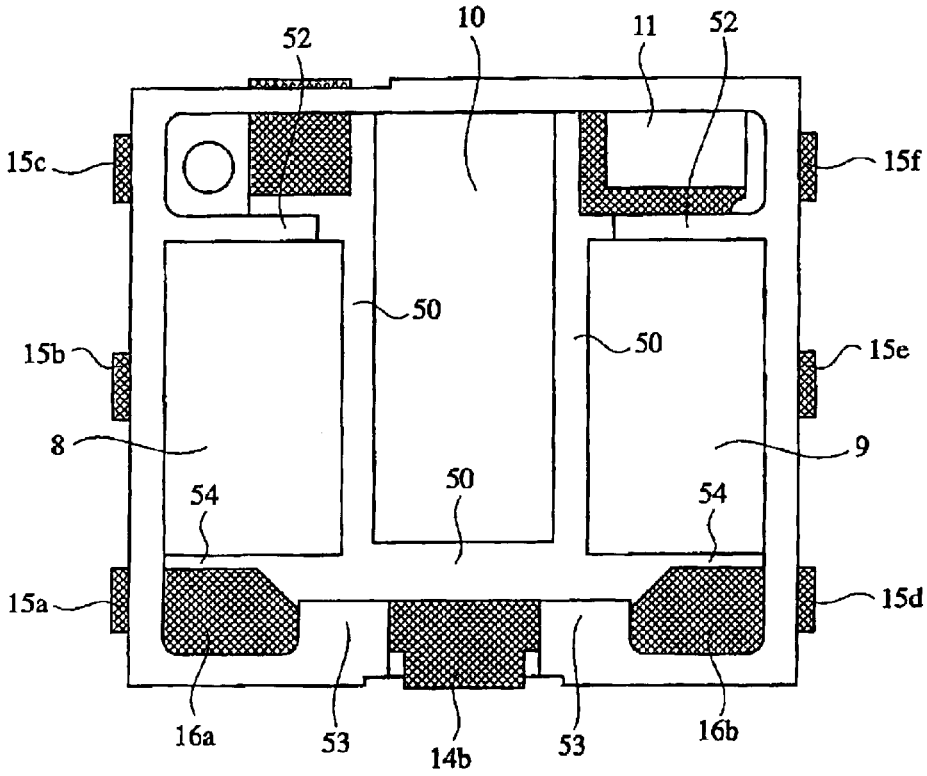
FIG. 8 is a plan view showing the resin casing of FIG. 1(*a*), in which flat capacitors are disposed.

The overall structure of the non-reciprocal circuit device of the present invention is shown in FIG. 7. As shown in FIG. 8, each flat capacitor 8, 9, 10 is received in each recess 13*b*, 13*c*, 13*d* of the resin casing 7. In the case of this embodiment, because the partition walls 50 are set to be as high as the flat capacitors 8, 9, 10 received in the recesses 13*b*, 13*c*, 13*d*, a flat surface is formed by the flat capacitors 8, 9, 10 and the partition walls 50. Incidentally, as long as there is no problem in fixing the flat capacitors 8, 9, 10, the upper surfaces of the partition walls 50 may be lower than the upper surfaces of the flat capacitors 8, 9, 10.

Figure 9A:
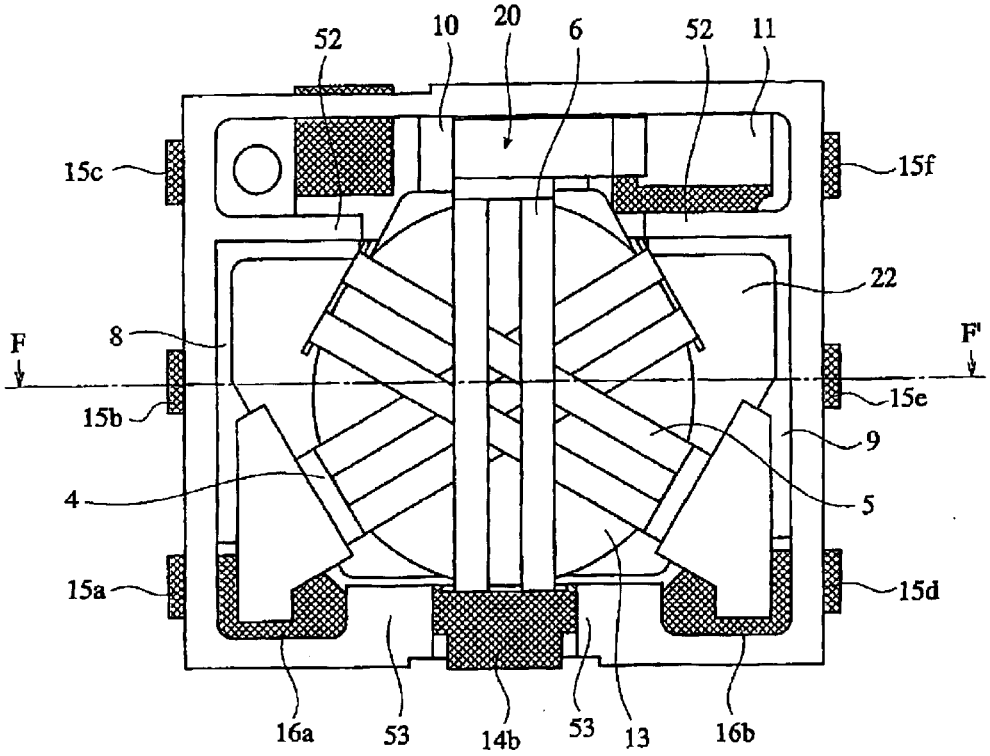
FIG. 9(*a*) is a plan view showing a resin casing for a non-reciprocal circuit device according to one embodiment of the present invention on the mounting surface side.
Figure 9B:
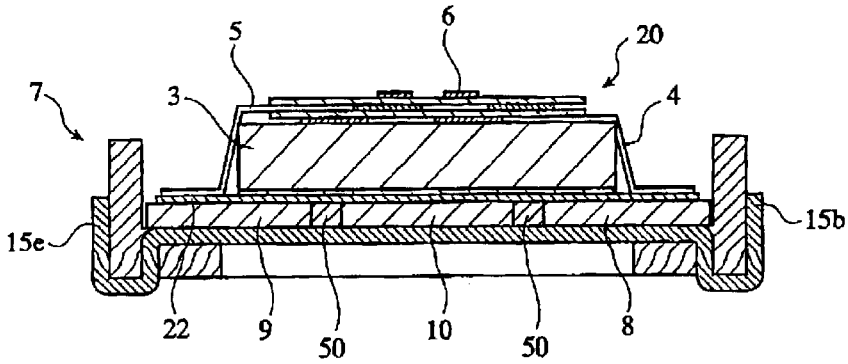

As shown in FIGS. 9(*a*) and (*b*), the assembly 20 is disposed on the upper surfaces of the flat capacitors 8, 9, 10 and the partition walls 50, the dummy resistor 11 is connected to the connecting electrode 14*a* in the recess 23, and the central conductors 4, 5, 6 of the assembly 20 is connected to the electrodes 16*a*, 16*b* and the dummy resistor 11. Thus obtained is a 4-mm-square isolator adapted to 800 MHz (D-AMPS, frequency: 824–849 MHz). Like a conventional isolator, this isolator comprises upper and lower metal casings 1, 12 functioning as magnetic yokes, a permanent magnet 2, the assembly 20, the flat capacitors 8, 9, 10, the dummy resistor 11 and the resin casing 7.

Figure 10:
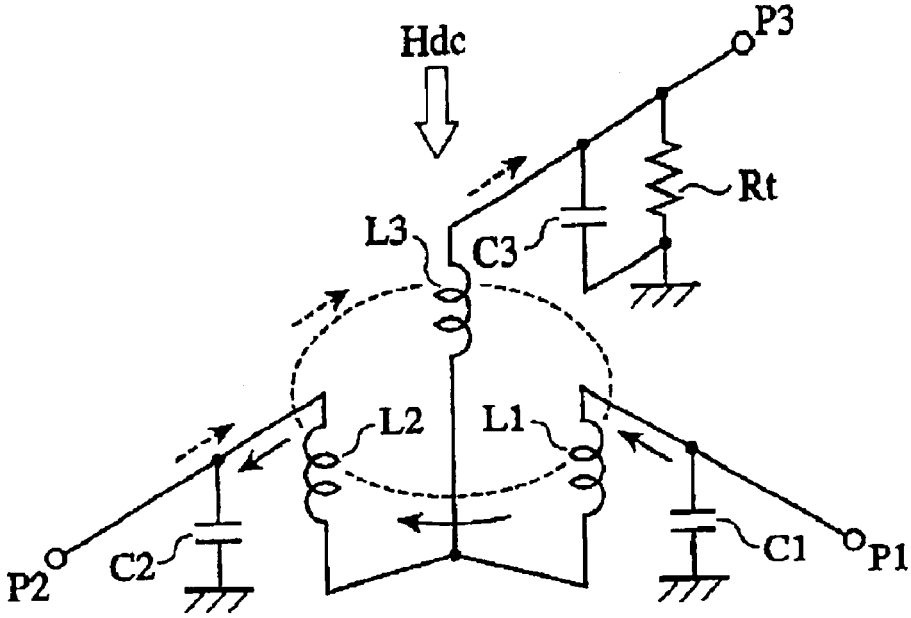
FIG. 10 is a view showing one example of the equivalent circuit of the non-reciprocal circuit device of the present invention.

FIG. 10 shows the equivalent circuit of an isolator according to one embodiment of the present invention. The garnet-type ferrite 3 wound with the central conductors 4, 5, 6 constitute inductance L1, L2, L3, and the flat capacitors 8, 9, 10 constitute capacitors C1, C2, C3. With inductance L1, L2, L3 and capacitance C1, C2, C3 controlled by the dummy resistor 11 (Rt) connected in parallel to the capacitor C3, an isolator operated at the desired center frequency $f_0$ is provided.

An important feature of this isolator is that the assembly 20 is disposed on the flat capacitors 8, 9, 10 via the insulating member 22; in other words, the assembly 20 and the flat capacitors 8, 9, 10 are disposed on different planes. This makes it possible not only to dispose the flat capacitors 8, 9, 10 on the same plane, but also to dispose the assembly 20 on a flat surface constituted by the upper surfaces of the flat capacitors 8, 9, 10. Accordingly, it is easy to mount the garnet and the capacitors in the desired sizes in the non-reciprocal circuit device.

Figure 11A:
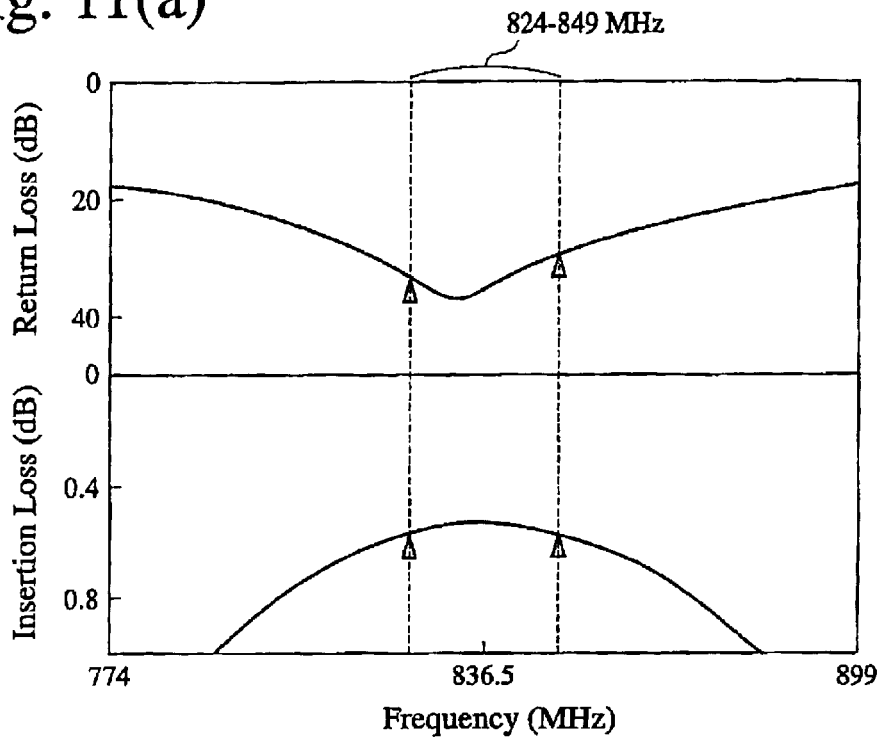
FIG. 11(*a*) is a graph showing the relation between insertion loss and frequency, and between return loss and frequency in the non-reciprocal circuit device of the first embodiment.
Figure 11B:
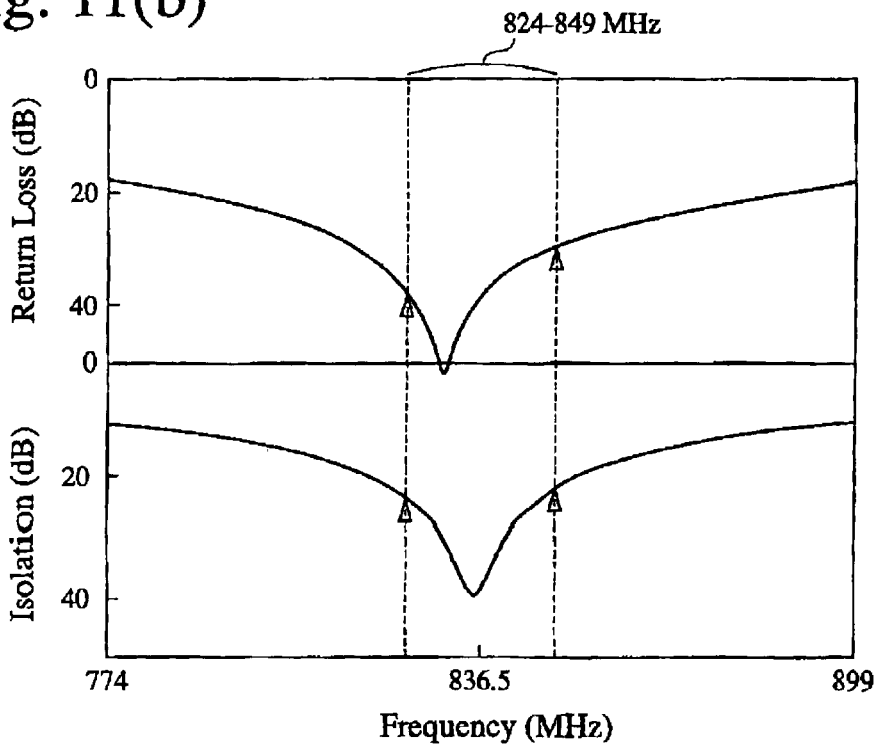

FIG. 11 shows the electric characteristics of the isolator according to the first embodiment. Specifically, FIG. 11(*a*) shows the frequency characteristics of insertion loss and return loss between an input port P1 (corresponding to an external terminal 15*a*) and an output port P2 (corresponding to an external terminal 15*d*), and FIG. 11(*b*) shows the frequency characteristics of isolation and return loss between the output port P2 and the input port P1.

In the isolator of the first embodiment, the insertion loss was 0.55 dB or less (peak value is 0.5 dB or less), and the isolation was 20 dB or more, both in a pass band. This proves that the present invention provides a small isolator with excellent electric characteristics.

[2] Second Embodiment

Figure 12A:
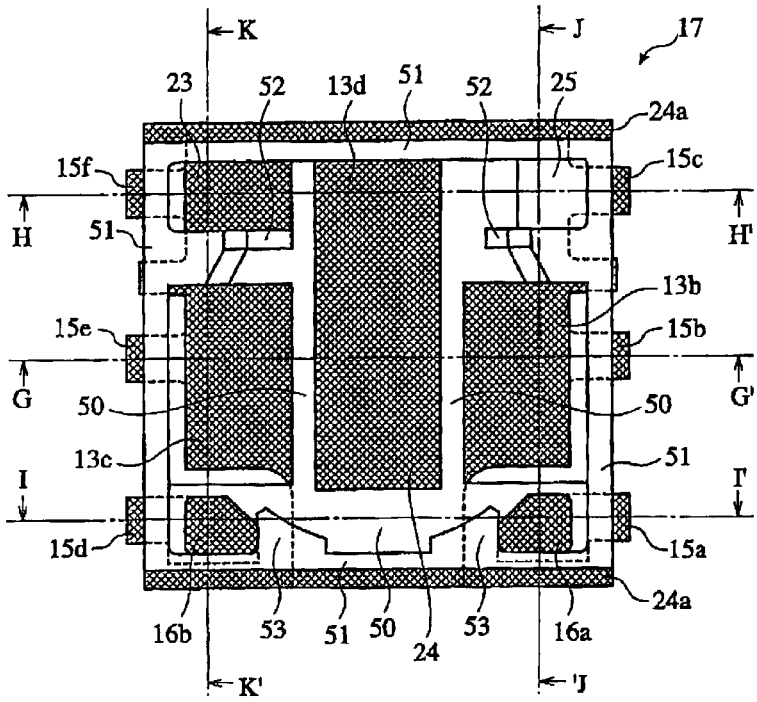
FIG. 12(*a*) is a plan view showing a resin casing for a non-reciprocal circuit device according to another embodiment of the present invention.
Figure 12B:
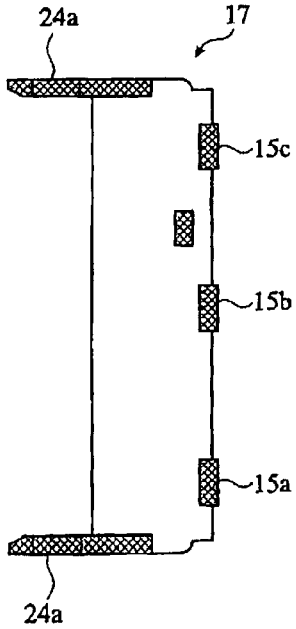
Figure 12C:
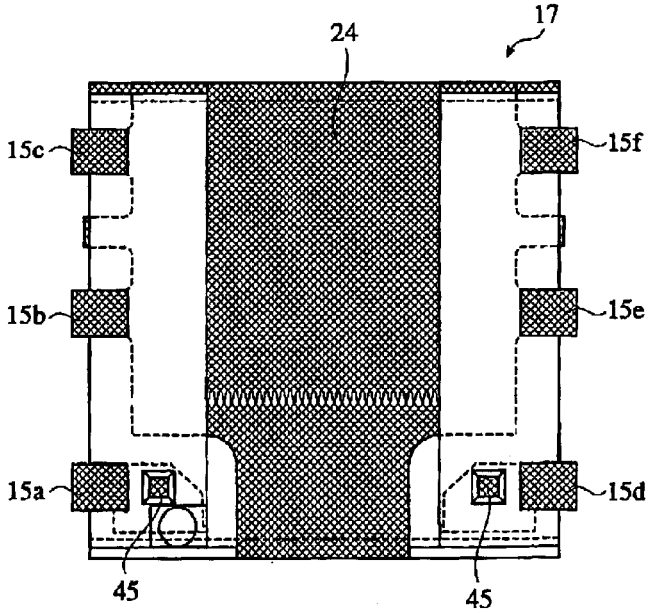
Figure 13A:
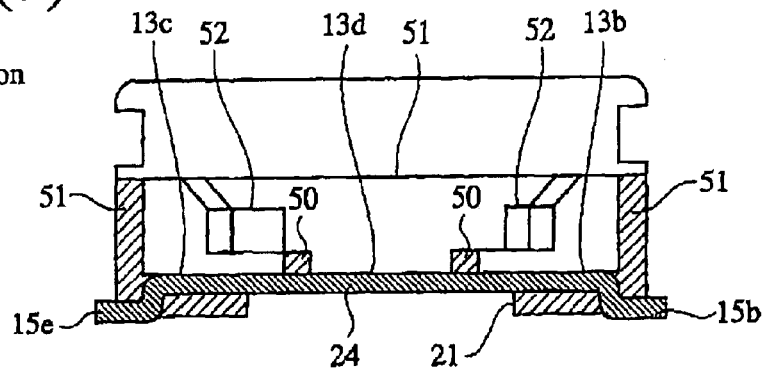
FIG. 13(*a*) is a cross-sectional view taken along the line G–G' in FIG. 12(*a*)
Figure 13B:
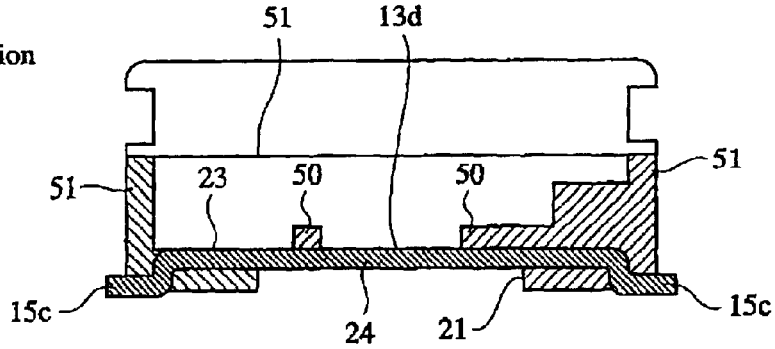
Figure 13C:
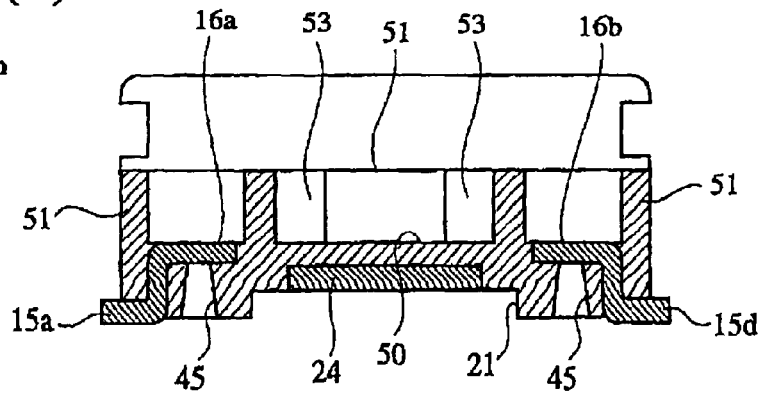
Figure 14A:
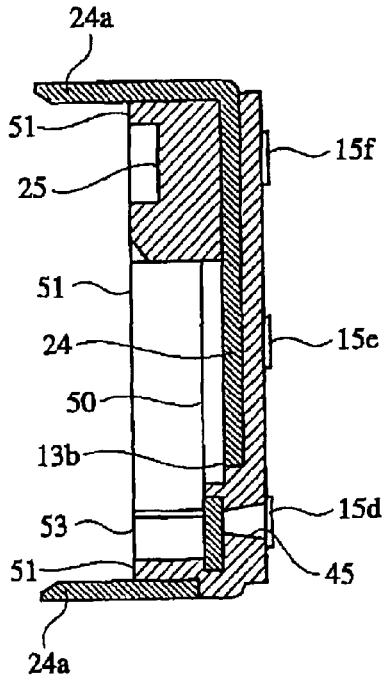
FIG. 14(*a*) is a cross-sectional view taken along the line J–J' in FIG. 12(*a*)
Figure 14B:
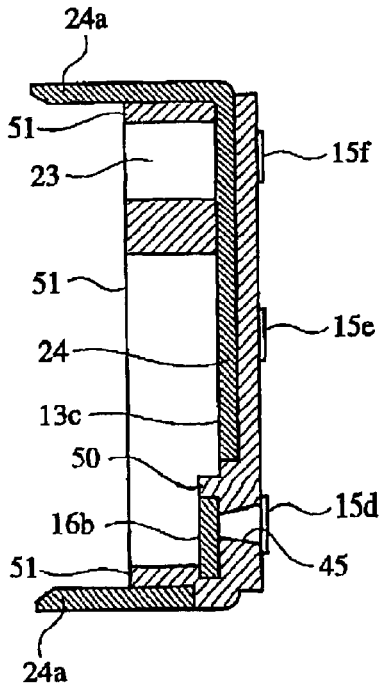

FIGS. 12–18 show a resin casing for a non-reciprocal circuit device according to the second embodiment. Because the resin casing of the second embodiment has parts common to the first embodiment, the same reference numerals are assigned to parts having the same functions. Detailed explanation will be made below only with respect to parts different from those of the first embodiment. As shown in FIG. 12, the non-reciprocal circuit device of the second embodiment is characterized by using a lower casing as a thin conductor plate for a resin casing 17.

Figure 18:
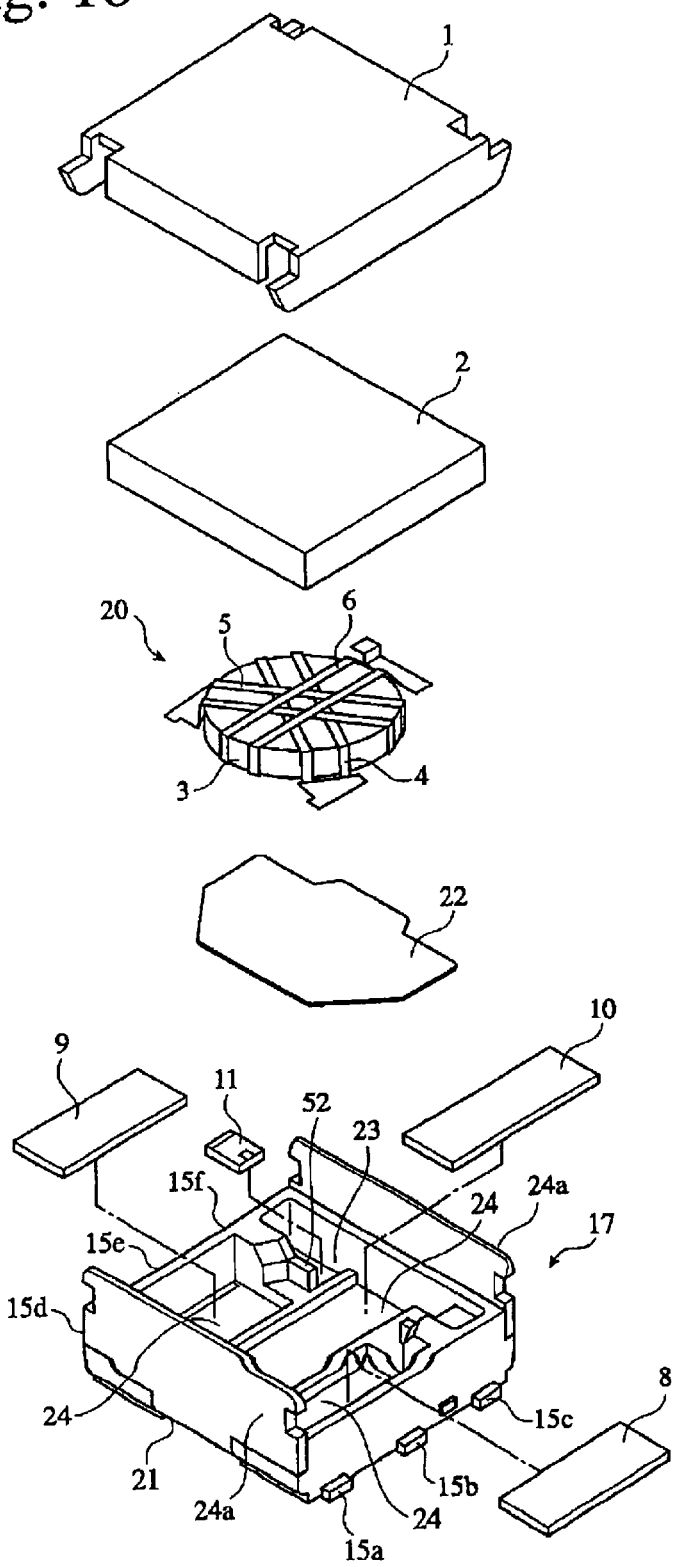
FIG. 18 is an exploded perspective view showing a non-reciprocal circuit device according to a further embodiment of the present invention.
Figure 19:
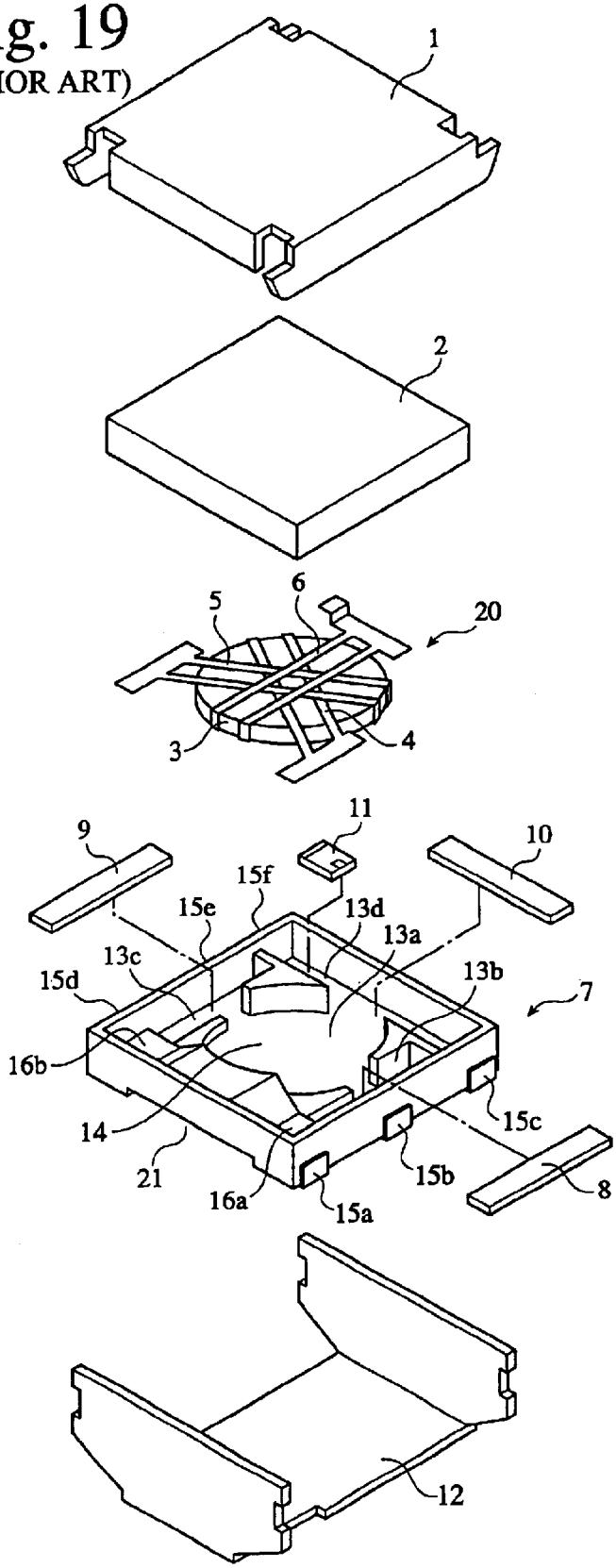
Fig. 19 (PRIOR ART)
FIG. 19 is an exploded perspective view showing a conventional non-reciprocal circuit device.

In the non-reciprocal circuit device of the second embodiment, too, partition walls 50 are lower than sidewalls 51, inner projecting portions 53 and partition walls 52, so that the flat capacitors 8, 9, 10 do not protrude from the upper surfaces of the partition walls 50 when each flat capacitor 8, 9, 10 is disposed on each recess 13*b*, 13*c*, 13*d*. Accordingly, the assembly 20 can stably be disposed on flat upper surfaces after mounting the flat capacitors 8, 9, 10. The overall structure of the non-reciprocal circuit device is shown in FIG. 18.

The conductor plate 24 serving not only as a lower casing but also as a magnetic yoke is bent in both opposing side portions to form sidewalls 24*a*, 24*a*. A thermoplastic resin is molded integrally with the conductor plate 24 bent in a rectangular U shape by an injection-molding method, to constitute a resin casing 17.

A recess 13*d* substantially at a center of the resin casing 17 may be different in depth from recesses 13*b*, 13*c* in which the other flat capacitors 8, 9 are disposed. In this case, what is necessary is to draw the conductor plate 24 to a desired extent. A rear surface portion of the conductor plate 24 corresponding to the recess 13*d* is protruded, and it is preferable to control the depth of the recess 13*d* properly, such that there is no interference with mounting surface. If a ground electrode is formed on a circuit board in a portion corresponding to the rear surface projection of the conductor plate 24, stable ground potential can be obtained, and bonding strength is improved between the circuit board and the non-reciprocal circuit device.

As shown in FIG. 12(*c*), input and output terminals 15*a*, 15*d* and ground terminals 15*b*, 15*c*, 15*e*, 15*f* are exposed from the bottom surface of the resin casing 17. Because there is a resin between the conductor plate 24 exposed from the bottom surface of the resin casing 17 and the input and output terminals 15*a*, 15*d* and the ground terminals 15*b*, 15*c*, 15*e*, 15*f*, no solder does not flow into the bottom surface of the lower casing from the input and output terminals 15*a*, 15*d* and the ground terminals 15*b*, 15*c*, 15*e*, 15*f* at the time of mounting the non-reciprocal circuit device onto the circuit board of an electronic equipment. As a result, the input and output terminals 15*a*, 15*d* and the ground terminals 15*b*, 15*c*, 15*e*, 15*f* can be soldered to the circuit board surely without short-circuiting, etc.

Figure 15A:
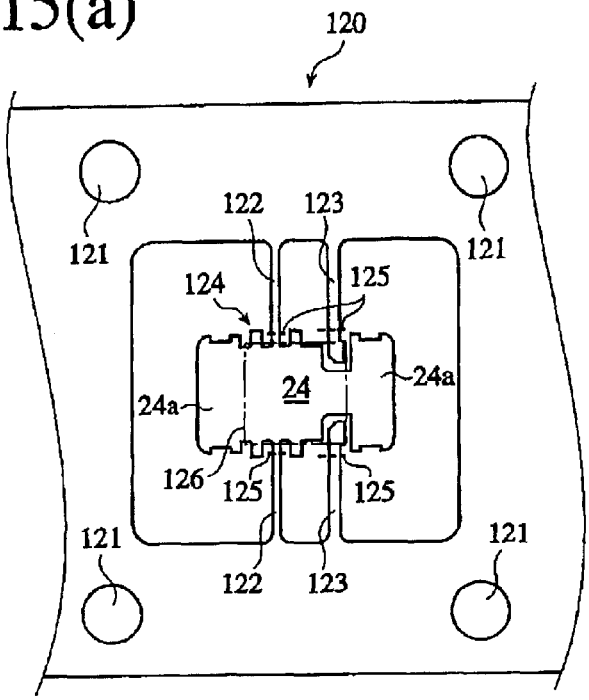
FIG. 15(*a*) is a plan view showing a leadframe for forming a metal plate used in the resin casing of FIG. 12(*a*)
Figure 15B:
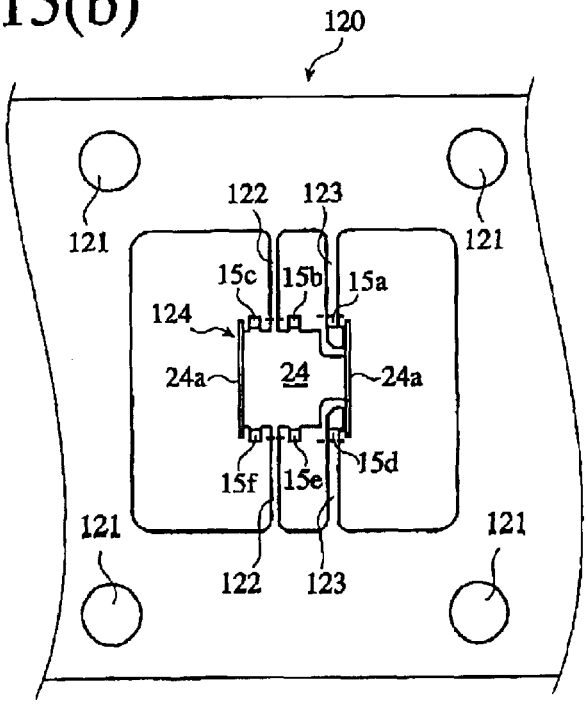

As shown in FIG. 15(*a*), to form the conductor plate 24, a long metal sheet is first continuously punched by a press machine to form a leadframe 120. In the second embodiment, because the conductor plate 24 serves as a lower casing (magnetic yoke), too, metal materials for the leadframe 120 are preferably SPCC, 42Ni—Fe alloys, 45Ni—Fe alloys, Fe—Co alloys, etc. with excellent magnetic properties, which are cold- or hot-rolled to about 100–300 $\mu$m. The magnetic properties of the metal materials for the leadframe 120 are preferably a maximum permeability of 5,000 or more and a saturation magnetic flux density of 1.4 Tesla or more.

The leadframe 120 is preferably coated with a high-conductivity metal layer made of at least one metal selected from the group consisting of silver, copper, gold and aluminum or its alloy, which has an electric resistivity of 5.5 $\mu\Omega$ cm or less, preferably 3.0 $\mu\Omega$ cm or less, more preferably 1.8 $\mu\Omega$ cm or less. The thickness of the high-conductivity metal layer is 0.5–25 $\mu$m, preferably 0.5–10 $\mu$m, more preferably 1–8 $\mu$m. When formed into the non-reciprocal circuit device, this metal layer functions to increase the transmission efficiency of high-frequency signals, with loss reduced by suppressing interference with the outside.

When the leadframe 120 is worked to magnetic yokes (conductor plate 24, upper casing 1), its metal layer may be destroyed so that its metal substrate is exposed. In such a case, metal materials for the leadframe 120 are preferably 42Ni—Fe alloys, 45Ni—Fe alloys, etc. with excellent oxidation resistance.

Because Fe—Co alloys, which have a maximum permeability of 15,000 and a saturation magnetic flux density of 2.25 Tesla, can be worked to extremely thin plates of about 100 $\mu$m in thickness, they are suitable for a magnetic yoke. A specific example of the composition of the Fe—Co alloy comprises 49% by mass of Co, 2% by mass of V, 0.015% by mass or less of C, 0.10% by mass or less of Si, and 0.15% by mass or less of Mn, the balance being substantially Fe and inevitable impurities. From the correlation between a frequency band in which the non-reciprocal circuit device is used and magnetic properties, Co is preferably 40–60% by mass, more preferably about 50% by mass. V is added to improve cold-workability, though it affects the magnetic properties of the resultant leadframe. Therefore, V is preferably 5% by mass or less, for instance, 2% by mass. When the Fe—Co alloys are used for the magnetic yoke, the leak of magnetic flux from the magnetic circuit can be sufficiently suppressed even if the magnetic yoke is made thin, making it possible to make the isolator further thinner and smaller.

Figure 17:
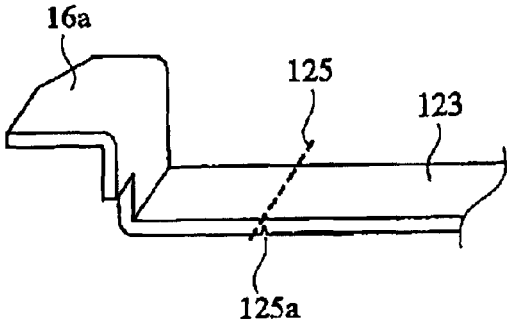
FIG. 17 is a partial cross-sectional view showing a portion of an external terminal, which is to be cut.

The long leadframe 120 has sprocket holes 120 at a constant interval in a hoop portion, and a metal sheet portion 124 for forming the conductor plate 24 is formed by punching between four sprocket holes 121. A plurality of supports 122, 123 extending from the hoop portion are connected to metal sheet portion 124, and each support 122, 123 is provided with a cutting line 125 formed by a V-shaped notch 125*a* as shown in FIG. 17. With such V-shaped notch 125*a*, there is no burr generated by cutting, thereby achieving sure soldering at the time of mounting the non-reciprocal circuit device onto the circuit board.

Figure 16:
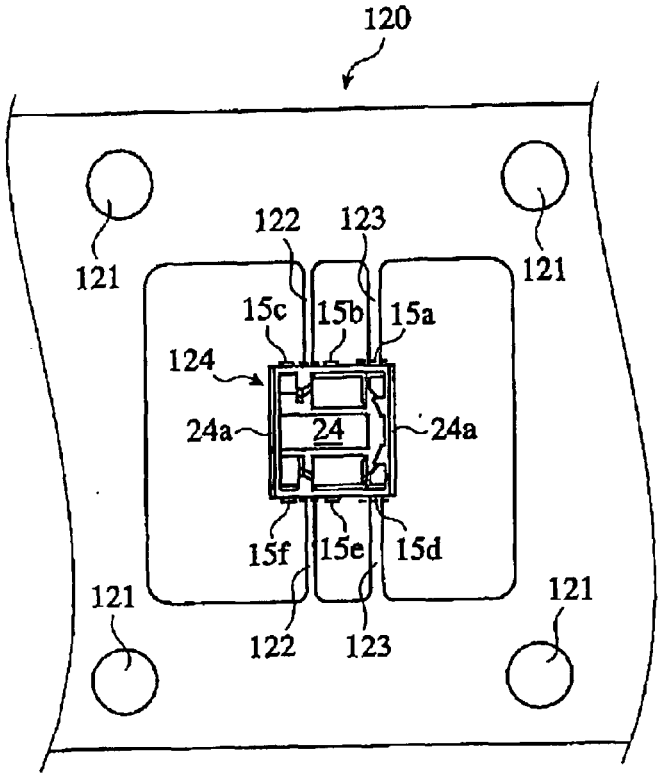
FIG. 16 is a plan view showing the leadframe of FIG. 15(*b*), to which a resin frame has been injection-molded.

As shown in FIG. 15(*b*), input and output terminals 15*a*, 15*d*, ground terminals 15*b*, 15*c*, 15*e*, 15*f*, and sidewalls 24*a*, 24*a* provided in the metal sheet portion 124 for the conductor plate 24 are bent. Next, the metal sheet portion 124 is placed in a cavity of an injection-molding machine, and the resin casing 17 is produced by an insert molding method using high-heat-resistance thermoplastic engineering plastics such as liquid crystal polymers and polyphenylene sulfide, as shown in FIG. 16.

A series of steps for producing the resin casing 17 can be carried out successively on a leadframe 120 having sprocket holes 121. The flat capacitors 8, 9, 10 and the resistor 11 are disposed in the recesses 13*b*, 13*c*, 13*d* encircled by the partition walls in the resin casing 17 formed by injection-molding a resin integrally with the conductor plate 24, and the assembly 20 is disposed on the flat capacitors 8, 9, 10 via an insulating sheet 22 made of a polyimide resin. One end of the central conductor 4 is connected to the upper electrode of the flat capacitor 8 and the terminal electrode 16*a*; one end of the central conductor 5 is connected to the upper electrode of the flat capacitor 9 and the terminal electrode 16*b*; and one end of the central conductor 6 is connected to the upper electrode of the flat capacitor 10 and the dummy resistor 11. The permanent magnet 2 for applying a DC magnetic field to the assembly 20 is disposed on the assembly 20, and an upper casing 1 for a magnetic yoke is mounted onto the resin casing 17. To connect the upper casing 1, through which high-frequency current flows, to the conductor plate 24 of the resin casing 17 electrically surely and mechanically fix them, it is preferable to solder them.

The non-reciprocal circuit device connected to the hoop portion of the leadframe 120 is thus obtained. After soldering by a reflow process, the non-reciprocal circuit device is cut away from the supports 122, 123 of the leadframe 120 at the V-shaped notches 125*a*.

In the second embodiment, because the lower casing is used as a conductor plate, it is possible to reduce the height of the non-reciprocal circuit device. Because flat capacitors are directly disposed on the conductor plate 24 serving as a lower casing, even when a force is applied from outside to the non-reciprocal circuit device, a force directly applied to the flat capacitors 8, 9, 10 can be reduced by the rigidity of a metal material constituting the conductor plate 24, resulting in decrease in the breakage of the flat capacitors 8, 9, 10.

As described above, with the resin casing of the present invention, the miniaturization of the non-reciprocal circuit device can be easily achieved, and the breakage of the flat capacitors by an outside force applied to the non-reciprocal circuit device can be effectively prevented. Accordingly, the non-reciprocal circuit device comprising such resin casing can be made small with high reliability.

Because flat capacitors having relatively large area can be disposed in the resin casing having the above structure, it is not necessary to make the flat capacitors extremely thin to achieve the desired capacitance level, resulting in securing sufficient mechanical strength in the flat capacitors. Accordingly, in place of using three separate flat capacitors as in the above embodiments, three pairs of electrodes may be formed on both sides of one dielectric substrate to provide an integral capacitor assembly, or a laminate capacitor may be constituted. In this case, the dummy resistor may be formed by printing on the dielectric substrate having capacitors. The dielectric substrate having a plurality of capacitors formed thereon may be mounted onto, for instance, the resin casing shown in FIG. 1 or 12, from which the partition walls 50, 52 are removed.

What is claimed is:

1. A resin casing used in a non-reciprocal circuit device comprising an assembly of a ferrimagnetic body and a plurality of central conductors enclosing said ferrimagnetic body, and a plurality of elongated flat capacitors connected to ends of said central conductors; said resin casing comprising a conductor plate constituting a magnetic yoke for said non-reciprocal circuit device and having a substantially flat bottom surface, and a resin frame injection-molded integrally with said conductor plate; said resin frame having sidewalls and partition walls inside said sidewalls for defining a plurality of recesses for receiving said flat capacitors; a pair of opposing sidewalls being provided with external terminals constituted by said conductor plate; any bottoms of a plurality of said recesses being integrally formed by a substantially flat bottom portion of said conductor plate; said recesses being formed such that said recesses receive all of said flat capacitors, each of said flat capacitors having a first side and a second side, said first side having a length greater than a length of said second side, all of said flat capacitors being arranged in said recesses such that said first side of each of said flat capacitors is substantially in parallel with sidewalls having said external terminals; and said assembly being disposed on said flat capacitors received in said recesses.

2. The resin casing for a non-reciprocal circuit device according to claim 1, having three recesses for receiving three elongated flat capacitors.

3. The resin casing for a non-reciprocal circuit device according to claim 1, wherein the electrode surfaces of flat capacitors connected to ends of said central conductors have substantially the same height.

4. The resin casing for a non-reciprocal circuit device according to claim 1, wherein said partition walls are not higher than the electrode surfaces of said flat capacitors connected to ends of said central conductors, said sidewalls are higher than the electrode surfaces of said flat capacitors.

5. The resin casing for a non-reciprocal circuit device according to claim 4, wherein said resin frame has second partition walls along short side surfaces of recesses adjacent to sidewalls having said external terminals, said second partition walls being higher than partition walls between said recesses and equal to or lower than said sidewalls.

6. A non-reciprocal circuit device comprising a resin casing, to which an assembly of a ferrimagnetic body and a plurality of central conductors enclosing said ferrimagnetic body, a permanent magnet for applying a DC magnetic field to said ferrimagnetic body, and a plurality of elongated flat capacitors connected to ends of said central conductors are assembled; said resin casing comprising a conductor plate constituting a magnetic yoke for said non-reciprocal circuit device and having a substantially flat bottom surface, and a resin frame injection-molded integrally with said conductor plate; said resin frame having sidewalls and partition walls inside said sidewalls for defining a plurality of recesses for receiving said flat capacitors; a pair of opposing sidewalls being provided with external terminals constituted by said thin conductor plate; any bottoms of a plurality of said recesses being integrally formed by a substantially flat bottom portion of said thin conductor plate; said recesses being formed such that said recesses receive all said flat capacitors, each of said flat capacitors having a first side and a second side, said first side having a length greater than a length of said second side, all of said flat capacitors being arranged in said recesses such that said first side of each of said flat capacitors is substantially in parallel with sidewalls having said external terminals; and said assembly being disposed on said flat capacitors received in said recesses.

7. The non-reciprocal circuit device according to claim 6, wherein the other ends of said central conductors are at substantially the same potential but not grounded.

8. The non-reciprocal circuit device according to claim 6, comprising a resistor connected in parallel to one of said flat capacitors, whereby it is operated as an isolator.

9. The non-reciprocal circuit device according to claim 8, wherein said resistor is disposed in a second recess enclosed by a second partition wall formed along a short side surface of a recess adjacent to a sidewall having said external terminals, and said sidewall.

10. The non-reciprocal circuit device according to claim 8, comprising three flat capacitors, one flat capacitor connected in parallel to said resistor being disposed between other two flat capacitors.

* * * * *